US005488754A

United States Patent [19]

Shadley

[11] Patent Number: 5,488,754

[45] Date of Patent: Feb. 6, 1996

[54] CEILING FAN VACUUM NOZZLE

[76] Inventor: Gerald K. Shadley, 3132 54th La. SW., Naples, Fla. 33999

[21] Appl. No.: 315,872

[22] Filed: Sep. 29, 1994

[51] Int. Cl.[6] ..... A47L 9/06

[52] U.S. Cl. ..... 15/394; 15/395; 15/398

[58] Field of Search ..... 15/398, 399, 400, 15/395, 394

[56] References Cited

U.S. PATENT DOCUMENTS

| | | | |
|---|---|---|---|
| 4,823,431 | 4/1989 | Carpenter | 15/394 |
| 5,235,722 | 8/1993 | Harris et al. | 15/394 |
| 5,313,687 | 5/1994 | Schneider | 15/394 |
| 5,359,751 | 11/1994 | Bellardini | 15/394 |

*Primary Examiner*—Chris K. Moore

[57] ABSTRACT

A new and improved ceiling fan vacuum nozzle with a T-shaped two piece housing having a first side and a second side, each having an upper portion and a lower portion. The upper portion has open end portions. The lower portion is integral with the downwardly extending opening in the upper portion. The lower portion functions to secure to a vacuum nozzle. The open end portions function to receive the blade from the ceiling fan therein. An inner wall is secured within the T-shaped two piece housing. The inner wall has a plurality of diagonally formed apertures therein. The plurality of diagonally formed apertures function to allow air flow throughout the two piece housing. A plurality of bristles are secured to the inner wall. The plurality of bristles taper towards a center portion of the inner wall. The plurality of bristles serve to remove dust particles from the ceiling fan.

4 Claims, 3 Drawing Sheets

CEILING FAN VACUUM NOZZLE

BACKGROUND OF THE INVENTION

1. Field of the Invention

The present invention relates to a ceiling fan vacuum nozzle and more particularly pertains to attaching to a vacuum cleaner to clean the blades of a ceiling fan with a ceiling fan vacuum nozzle.

2. Description of the Prior Art

The use of cleaning apparatuses is known in the prior art. More specifically, cleaning apparatuses heretofore devised and utilized for the purpose of cleaning ceiling fans are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,116,151 to Lytton et al. discloses a ceiling fan cleaning apparatus.

U.S. Pat. No. 5,235,722 to Harris et al. discloses a vacuum fan duster.

U.S. Pat. No. Des. 341,452 to Songer discloses the ornamental design for a vacuum cleaner attachment for cleaning ceiling fan blades.

U.S. Pat. No. 5,018,944 to Bielecki et al. discloses a ceiling fan cleaner apparatus.

U.S. Pat. No. 4,827,556 to Corsetti discloses ceiling fan blade cleaning devices.

While these devices fulfill their respective, particular objective and requirements, the aforementioned patents do not describe a ceiling fan vacuum nozzle for attaching to a vacuum cleaner to clean the blades of a ceiling fan.

In this respect, the ceiling fan vacuum nozzle according to the present invention substantially departs from the conventional concepts and designs of the prior art, and in doing so provides an apparatus primarily developed for the purpose of attaching to a vacuum cleaner to clean the blades of a ceiling fan.

Therefore, it can be appreciated that there exists a continuing need for a new and improved ceiling fan vacuum nozzle which can be used for attaching to a vacuum cleaner to clean the blades of a ceiling fan. In this regard, the present invention substantially fulfills this need.

SUMMARY OF THE INVENTION

In the view of the foregoing disadvantages inherent in the known types of cleaning apparatuses now present in the prior art, the present invention provides an improved ceiling fan vacuum nozzle. As such, the general purpose of the present invention, which will be described subsequently in greater detail, is to provide a new and improved ceiling fan vacuum nozzle and method which has all the advantages of the prior art and none of the disadvantages.

To attain this, the present invention essentially comprises a T-shaped two piece housing having a first side and a second side. The first side and the second side each has an upper portion and a lower portion. The upper portion has open end portions. The upper portion has an inner cavity and a downwardly extending opening therein. The lower portion has an open upper end and an open lower end. The open upper end is integral with the downwardly extending opening in the upper portion. The open lower end is tapered. The open lower end functions to secure to a vacuum nozzle. The upper portion and the lower portion of the first side and the second side have a plurality of pegs and holes to facilitate the coupling of the first side to the second side. The open end portions function to receive the blade from the ceiling fan therein. The device contains an inner wall having an inner surface and an outer surface. The outer surface is secured to the inner cavity of the T-shaped two piece housing. The inner wall has a plurality of diagonally formed apertures therein. The plurality of diagonally formed apertures function to allow air flow throughout the T-shaped two piece housing. The device contains a plurality of bristles secured to the inner surface of the inner wall. The plurality of bristles taper towards a center portion of the inner wall. The plurality of bristles serve to remove dust particles from the ceiling fan. The device contains an optional brush attachment having an upper end and a lower end. The upper end is optionally secured to the open lower end of the T-shaped two piece housing. The brush attachment functions to give the user a greater ability to reach the ceiling fan.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved ceiling fan vacuum nozzle which has all the advantages of the prior art cleaning apparatuses and none of the disadvantages.

It is another object of the present invention to provide a new and improved ceiling fan vacuum nozzle which may be easily and efficiently manufactured and marketed.

It is a further object of the present invention to provide a new and improved ceiling fan vacuum nozzle which is of durable and reliable construction.

An even further object of the present invention is to provide a new and improved ceiling fan vacuum nozzle which is susceptible of a low cost of manufacture with regard to both materials and labor, and which accordingly is then susceptible of low prices of sale to the consuming public, thereby making such a ceiling fan vacuum nozzle economically available to the buying public.

Still yet another object of the present invention is to provide a new and improved ceiling fan vacuum nozzle which provides in the apparatuses and methods of the prior art some of the advantages thereof, while simultaneously overcoming some of the disadvantages normally associated therewith.

Even still another object of the present invention is to provide a new and improved ceiling fan vacuum nozzle for attaching to a vacuum cleaner to clean the blades of a ceiling fan.

Lastly, it is an object of the present invention to provide a new and improved ceiling fan vacuum nozzle with a T-shaped two piece housing having a first side and a second side, each having an upper portion and a lower portion. The upper portion has open end portions. The lower portion is integral with the downwardly extending opening in the upper portion. The lower portion functions to secure to a vacuum nozzle. The open end portions function to receive the blade from the ceiling fan therein. An inner wall is secured within the T-shaped two piece housing. The inner wall has a plurality of diagonally formed apertures therein. The plurality of diagonally formed apertures function to allow air flow throughout the two piece housing. A plurality of bristles are secured to the inner wall. The plurality of bristles taper towards a center portion of the inner wall. The plurality of bristles serve to remove dust particles from the ceiling fan.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
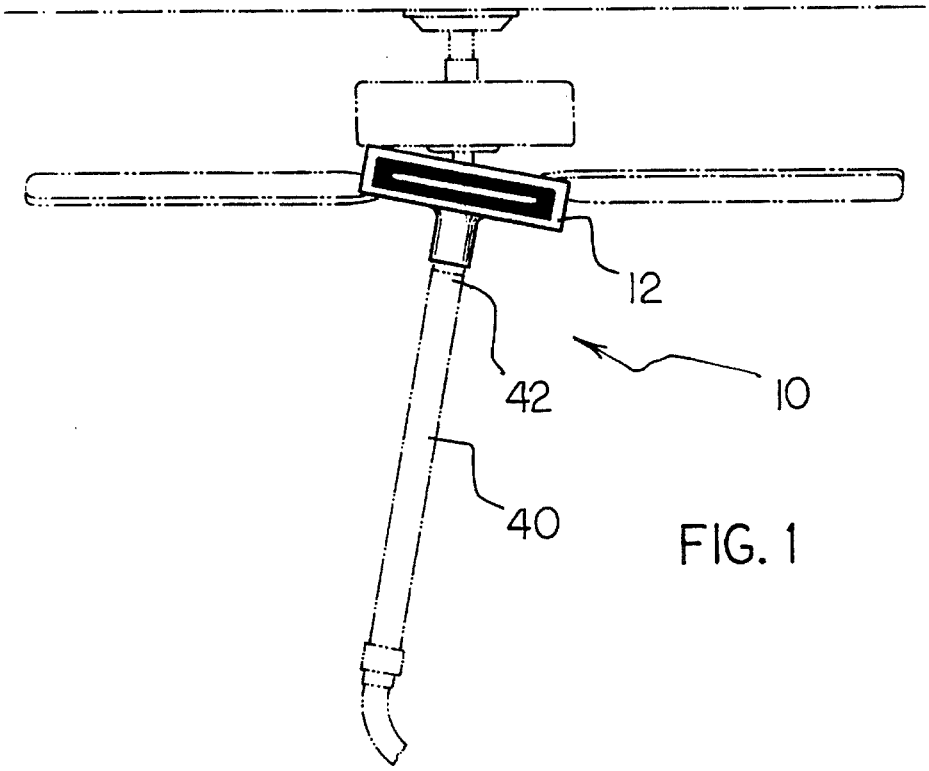
FIG. 1 is an elevated view of the present invention illustrated cleaning a ceiling fan blade.
Figure 2:
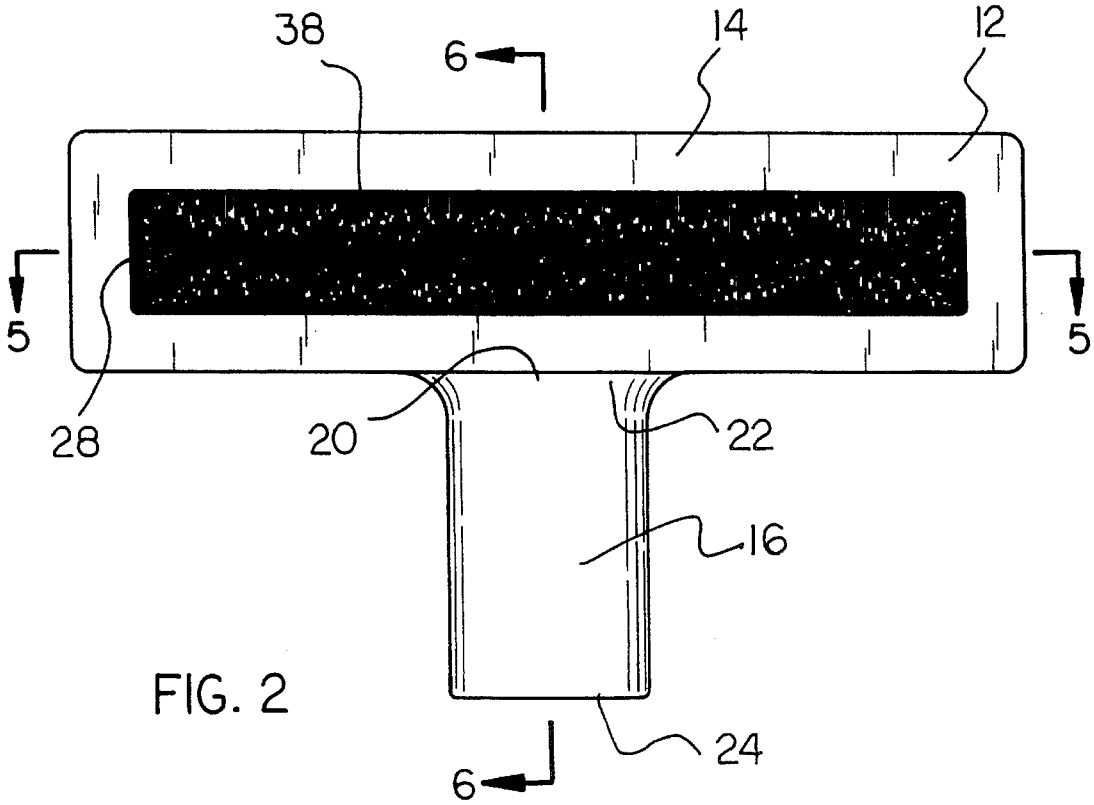
FIG. 2 is a perspective view of the preferred embodiment of the ceiling fan vacuum nozzle constructed in accordance with the principles of the present invention.
Figure 3:
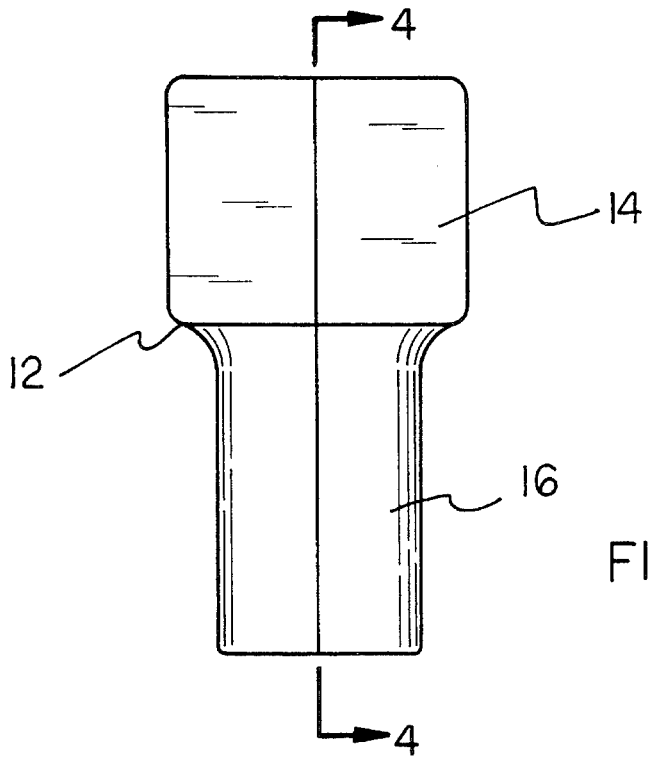
FIG. 3 is a side view of the present invention.
Figure 4:
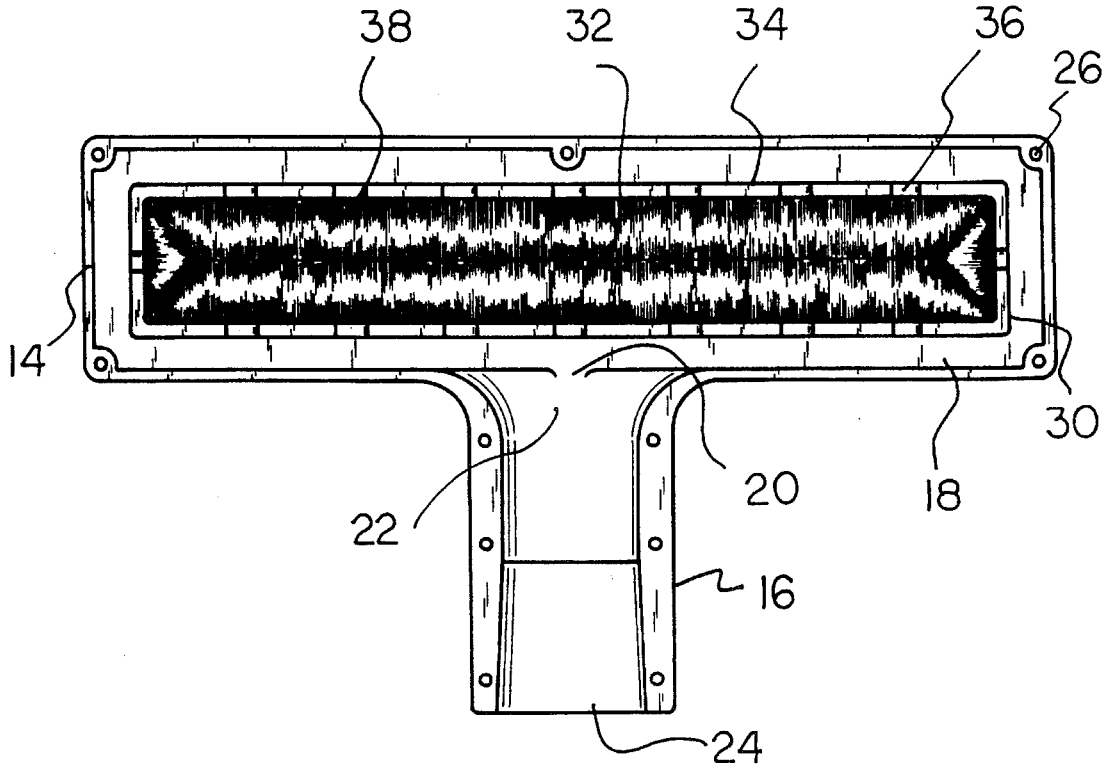
FIG. 4 is a cross-sectional view of the present invention taken along line 4—4 of FIG. 3.
Figure 5:
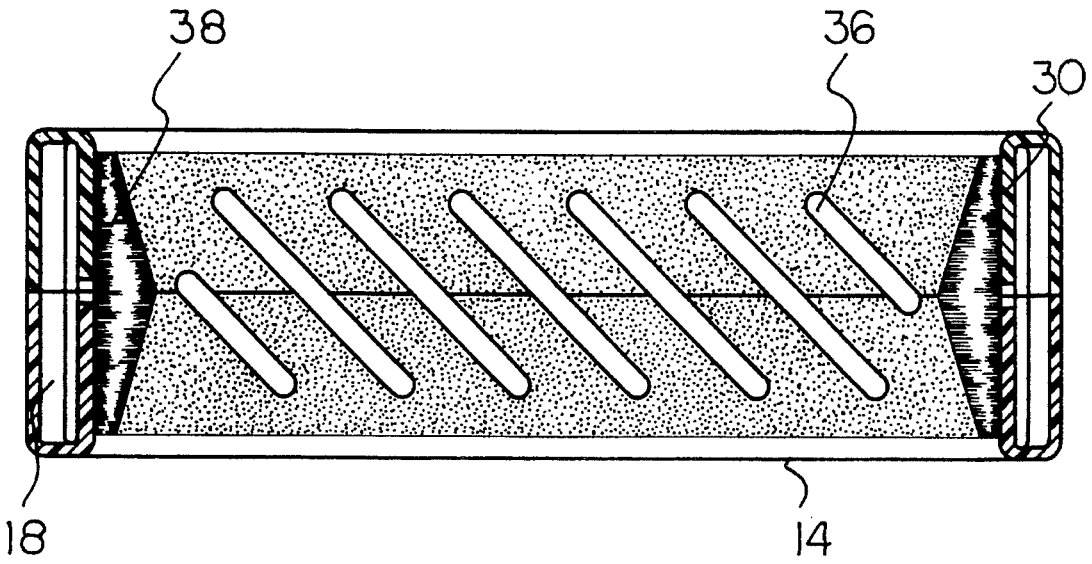
FIG. 5 is a cross-sectional view of the present invention taken along line 5—5 of FIG. 2.
Figure 6:
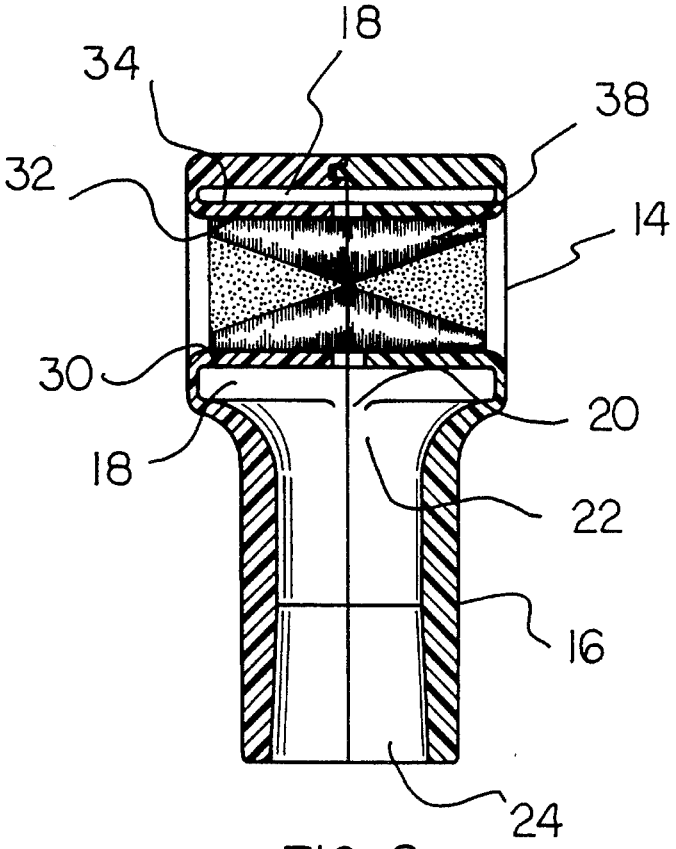
FIG. 6 is a cross-sectional view of the present invention taken along line 6—6 of FIG. 2.

With reference now to the drawings, and in particular, to FIG. 1 thereof, the preferred embodiment of the new and improved ceiling fan vacuum nozzle embodying the principles and concepts of the present invention and generally designated by the reference number 10 will be described.

Specifically, it will be noted in the various figures that the device relates to a new and improved ceiling fan vacuum nozzle for attaching to a vacuum cleaner to clean the blades of a ceiling fan. In its broadest context, the device consists of a housing, an inner wall, a plurality of bristles, and an optional brush attachment.

The device 10 contains a T-shaped two piece housing 12 having a first side and a second side. The first side and the second side each has an upper portion 14 and a lower portion 16. The upper portion 14 has open end portions 28. The upper portion has an inner cavity 18 and a downwardly extending opening 20 therein. The opening serves as the point where dust exits the T-shaped two piece housing 12. The lower portion 16 has an open upper end 22 and an open lower end 24. The open upper end 22 is integral with the downwardly extending opening 20 in the upper portion 14. The open lower end 24 is tapered. The open lower end 24 functions to secure to a vacuum nozzle. The upper portion 14 and the lower portion 16 of the first side and the second side have a plurality of pegs and holes 26 to facilitate the coupling of the first side to the second side. The open end portions 28 function to receive the blade from the ceiling fan therein.

The device 10 contains an inner wall 30 having an inner surface 32 and an outer surface 34. The outer surface 34 is secured to the inner cavity 18 of the T-shaped two piece housing 12. The inner wall 30 has a plurality of diagonally formed apertures 36 therein. The plurality of diagonally formed apertures 36 function to allow air flow throughout the T-shaped two piece housing 12. The diagonally formed apertures permit air flow all around the T-shaped two piece housing 12. The apertures 36 permit the blade to be thoroughly cleaned without leaving any streaks or blemishes.

The device 10 contains a plurality of bristles 38 secured to the inner surface 32 of the inner wall 30. The plurality of bristles 38 taper towards a center portion of the inner wall. The plurality of bristles 38 serve to remove dust particles from the ceiling fan. The bristles are made of a durable plastic or, more preferably, nylon. The tapering of the bristles 38 allows the dust to be sucked up by the vacuum and not brushed away. The tapering also allows the ceiling fan to be entered into the device 10 from either of the open end portions 28.

The device 10 contains an optional brush attachment 40 having an upper end 42 and a lower end 44. The upper end 42 is optionally secured to the open lower end 24 of the T-shaped two piece housing 12. The brush attachment 40 functions to give the user a greater ability to reach the ceiling fan. The brush attachment can be omitted to reduce the cost of the device 10, but considering the height that some ceiling fans are above the floor, such an option can entice purchasers.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A new and improved ceiling fan vacuum nozzle for attaching to a vacuum cleaner to clean the blades of a ceiling fan comprising, in combination:

a T-shaped two piece housing having a first side and a second side, the first side and the second side each having an upper portion and a lower portion, the upper portion having open end portions, the upper portion having an inner cavity and a downwardly extending opening therein, the lower portion having an open upper end and an open lower end, the open upper end integral with the downwardly extending opening in the upper portion, the open lower end being tapered, the open lower end functioning to secure to a vacuum hose end, the upper portion and the lower portion of the first side and the second side having a plurality of pegs and holes to facilitate the coupling of the first side to the second side, the open end portions functioning to receive the blade from the ceiling fan therein;

an inner wall having an inner surface and an outer surface, the outer surface secured to the inner cavity of the T-shaped two piece housing, the inner wall having a plurality of diagonally formed apertures therein, the plurality of diagonally formed apertures functioning to allow air flow to enter the T-shaped two piece housing;

a plurality of bristles secured to the inner surface of the inner wall, the plurality of bristles tapering towards a center portion of the inner wall, the plurality of bristles serving to remove dust particles from the ceiling fan; and an attachment having an upper end and a lower end, the upper end optionally secured to the open lower end of the T-shaped two piece housing, the attachment functioning to give the user a greater ability to reach the ceiling fan.

2. A ceiling fan vacuum nozzle for attaching to a vacuum cleaner to clean the blades of a ceiling fan comprising:

a T-shaped two piece housing having a first side and a second side, each having an upper portion and a lower portion, the upper portion having open end portions, the lower portion integral with the downwardly extending opening in the upper portion, the lower portion functioning to secure to a vacuum hose end, the open end portions functioning to receive the blade from the ceiling fan therein;

an inner wall secured within the T-shaped two piece housing, the inner wall having a plurality of diagonally formed apertures therein, the plurality of diagonally formed apertures functioning to allow air flow to enter the two piece housing; and a plurality of bristles secured to the inner wall, the plurality of bristles tapering towards a center portion of the inner wall, the plurality of bristles serving to remove dust particles from the ceiling fan.

3. The device as described in claim 2 and further comprising wherein the upper portion and the lower portion of the first side and the second side of the T-shaped two piece housing has a plurality of pegs and holes to facilitate the coupling of the first side to the second side.

4. The device as described in claim 3 and further comprising wherein an attachment has an upper end and a lower end, the upper end optionally secured to the lower portion of the T-shaped two piece housing, the attachment functioning to give the user a greater ability to reach the ceiling fan.

* * * * *